US007389853B2

(12) United States Patent
Ryczek et al.

(10) Patent No.: US 7,389,853 B2
(45) Date of Patent: Jun. 24, 2008

(54) MUFFLER FOR AN ENGINE

(75) Inventors: Stephen J. Ryczek, Hartland, WI (US); James D. Makiya, Wauwatosa, WI (US); William M. Kindness, Franklin, WI (US); Kyle Clasen, Hartford, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 322 days.

(21) Appl. No.: 10/852,081

(22) Filed: May 24, 2004

(65) Prior Publication Data

US 2005/0258001 A1 Nov. 24, 2005

(51) Int. Cl.
*F01N 1/08* (2006.01)

(52) U.S. Cl. ..... 181/272; 181/230; 181/264; 181/265; 181/270

(58) Field of Classification Search ..... 181/272, 181/230, 264–265, 270
See application file for complete search history.

(56) References Cited

U.S. PATENT DOCUMENTS 4,132,286 A 1/1979 Hasui et al.
4,267,899 A * 5/1981 Wagner et al. ..... 181/272
4,416,350 A 11/1983 Hayashi
4,574,913 A 3/1986 Fukuda
5,177,962 A * 1/1993 Hall et al. ..... 60/311
5,218,817 A * 6/1993 Urata ..... 60/274
5,894,115 A 4/1999 Weiner
6,041,890 A 3/2000 Wolf et al.
6,044,926 A 4/2000 Yamane et al.
6,250,422 B1 * 6/2001 Goplen et al. ..... 181/272
6,364,054 B1 4/2002 Bubulka et al.
6,457,553 B1 * 10/2002 Goplen et al. ..... 181/272

FOREIGN PATENT DOCUMENTS

CA 2503296 3/2005
EP 0731257 A2 11/1996

* cited by examiner

*Primary Examiner*—Stephen W Jackson
*Assistant Examiner*—Terrence R Willoughby
(74) *Attorney, Agent, or Firm*—Michael Best & Friedrich LLP

(57) ABSTRACT

A muffler suited for use in discharging exhaust gas from an engine. The muffler generally includes a housing that defines a muffler interior, an inlet aperture, and an outlet aperture. A baffle that defines a baffle interior is positioned to divide the muffler interior into an inlet space and an intermediate space. A first aperture is defined within the baffle to provide fluid communication between the inlet space and the intermediate space and a second aperture is formed within the baffle to provide for fluid communication between the intermediate space and the baffle interior. A flow guide is integrally formed with the baffle and is positioned to direct exhaust gas from the baffle interior through the outlet aperture.

30 Claims, 4 Drawing Sheets

MUFFLER FOR AN ENGINE

BACKGROUND

The present invention relates generally to a muffler for an engine. More particularly, the present invention relates to a muffler for an engine that operates in a cold environment.

Mufflers are generally provided with combustion engines (e.g., internal combustion engines, diesel engines, and the like) to reduce the engine noise during operation. Typical mufflers include a housing and baffles that define a circuitous flow path from a muffler inlet to a muffler outlet. The turns in the flow path reduce the pressure and flow velocity of the exhaust gas, thereby reducing the noise produced by the exhaust gas as it exits the muffler.

Typical mufflers include multiple metal components that are welded or crimped together to define the completed muffler. The welding and other manufacturing steps can make the muffler expensive to manufacture. In addition, detailed quality control or inspections are often required to assure that the welding steps are performed correctly.

SUMMARY

The present invention provides a muffler suited for use in discharging exhaust gas from an engine. The muffler generally includes a housing that defines a muffler interior, an inlet aperture, and an outlet aperture. A baffle that defines a baffle interior is positioned to divide the muffler interior into an inlet space and an intermediate space. A first aperture is defined within the baffle to provide fluid communication between the inlet space and the intermediate space, and a second aperture is formed within the baffle to provide for fluid communication between the intermediate space and the baffle interior. A flow guide is integrally formed with the baffle and is positioned to direct exhaust gas from the baffle interior through the outlet aperture.

In another aspect, the invention provides a muffler suited for use in discharging a flow of exhaust gas from an engine. The muffler generally includes a housing having a first half and a second half connected to the first half to define a perimeter joint and a muffler interior. A first baffle has a first flow guide portion and a first divider portion engaged with the perimeter joint to divide the muffler interior into an inlet space and an intermediate space. A second baffle has a second flow guide portion and a second divider portion engaged with the perimeter joint. The first flow guide portion and the second flow guide portion cooperate to define a discharge space. The first flow guide portion, the second flow guide portion, and the housing cooperate to define an outlet. The first baffle and the second baffle cooperate to define a first aperture that provides for fluid communication between the inlet space and the intermediate space. The second baffle defines a second aperture that provides for fluid communication between the intermediate space and the discharge space.

In still another aspect, the present invention provides an engine generally including a cylinder including an exhaust port for the discharge of exhaust gas and a piston arranged for reciprocal movement within the cylinder. The engine also includes an air/fuel mixing device that is operable to mix a flow of air and a flow of fuel. The engine further includes a muffler having a housing defining a muffler interior, an inlet aperture for receiving the exhaust gas, and an outlet aperture for discharging the exhaust gas. A baffle is disposed within the housing to define an inlet space, an intermediate space, and an outlet space. The baffle includes a first aperture that provides fluid communication between the inlet space and the intermediate space, and a second aperture that provides fluid communication between the intermediate space and the outlet space. A flow guide is integrally formed as part of the baffle and is positioned to guide exhaust gas from the outlet space out of the muffler.

Additional features and advantages will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION

Figure 1:
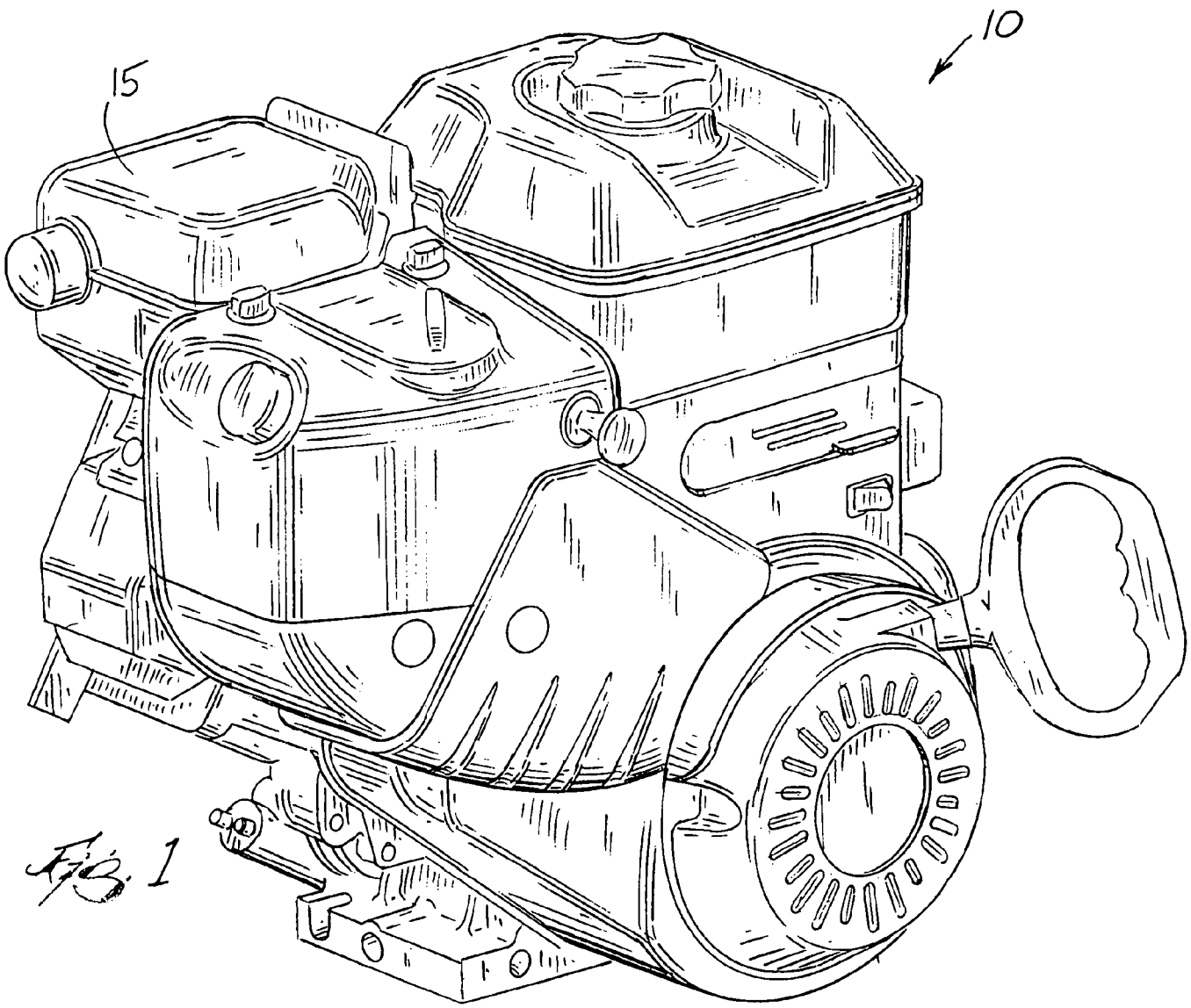
FIG. 1 is a perspective view of an engine including a muffler.

With reference to FIG. 1, an engine 10 including a muffler 15 is illustrated. The engine 10 is specially suited for use in cold-weather applications such as for powering a snow blower. However, engines of this type are also suited to power other types of outdoor power equipment (e.g., rototillers, power augers, edgers, log-splitters, string-trimmers, chipper/shredders, lawn mowers, pressure washers, and generators).

The engine 10 includes a piston positioned within a cylinder and reciprocal to rotate a drive shaft. The drive shaft powers the device (e.g., lawn mower blade, snow blower auger, and the like) to which the engine 10 is attached. An air/fuel mixing device, such as a carburetor (not shown), mixes the air and fuel and delivers the mixture to the cylinder for combustion. A spark plug or other spark-producing device ignites the air/fuel mixture to combust the mixture and produce power and products of combustion. The products of combustion are then discharged to the muffler 15 as a flow of exhaust gas. It should be noted that the present invention will function with any type of combustion engine for which a muffler 15 is typically used. For example, the present invention is well suited to use with a diesel engine. As such, the invention should not be limited to applications that employ an internal combustion engine.

Figure 2:
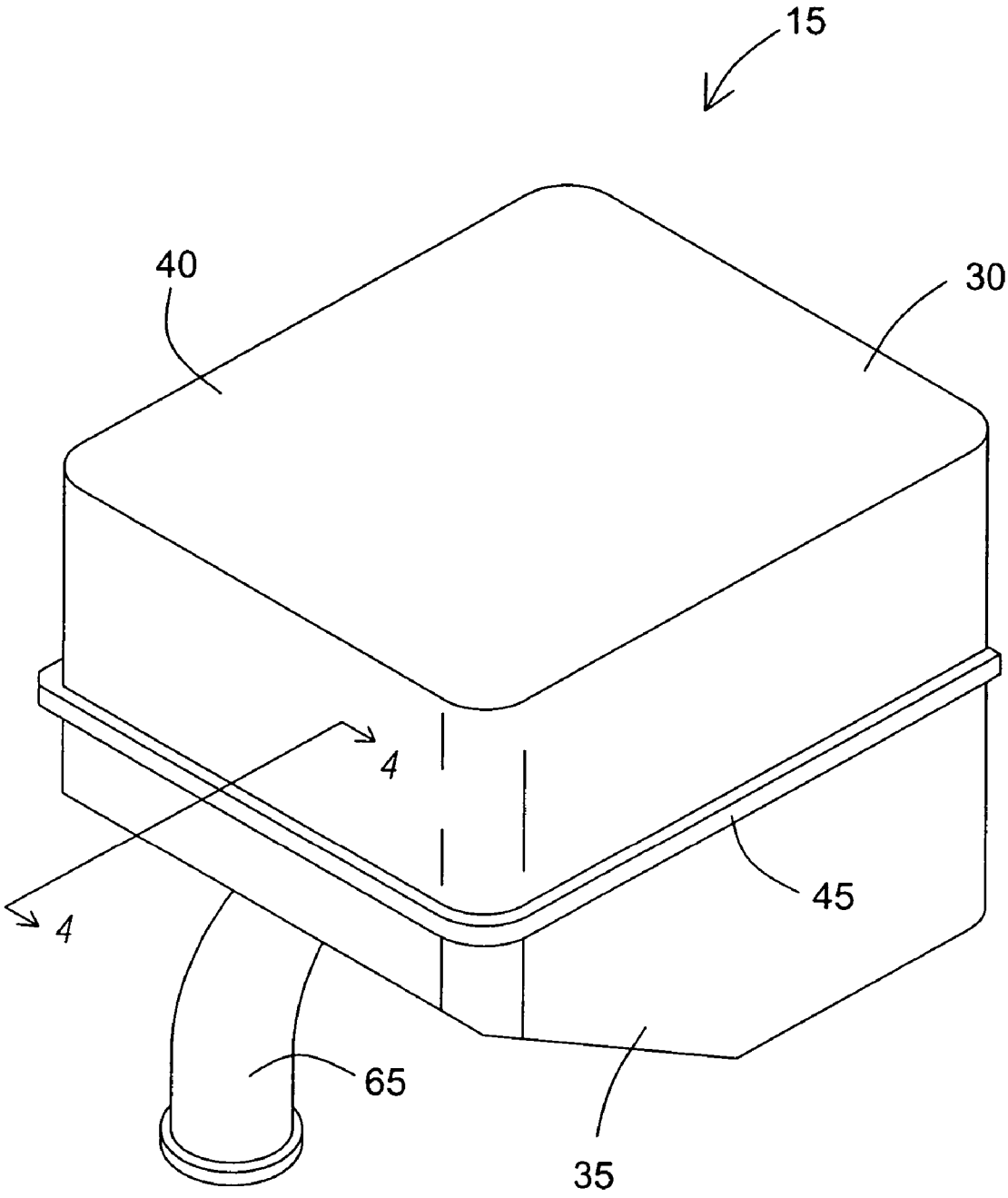
FIG. 2 is a perspective view of the muffler of FIG. 1.

The muffler 15, illustrated in FIG. 2, includes a housing 30 made up of a first half 35 and a second half 40. The second half 40 attaches to the first half 35 along a perimeter joint 45 that extends around a significant portion of the muffler housing 30 to define a muffler interior 50. The housing 30 defines an inlet 55 that receives the flow of exhaust gas from the cylinder and an outlet 60 (shown in FIG. 3) that discharges the flow of exhaust gas from the muffler 15. The inlet 55 is completely defined by the first half 35 of the housing 30. However, other constructions may position the inlet 55 in the second half 40 or may form the inlet 55 using both halves 35, 40 of the housing 30. The inlet 55 is illustrated as including a pipe 65 that interconnects the cylinder and the muffler 15. However, other constructions may provide for a more direct connection between the muffler 15 and the cylinder.

Figure 3:
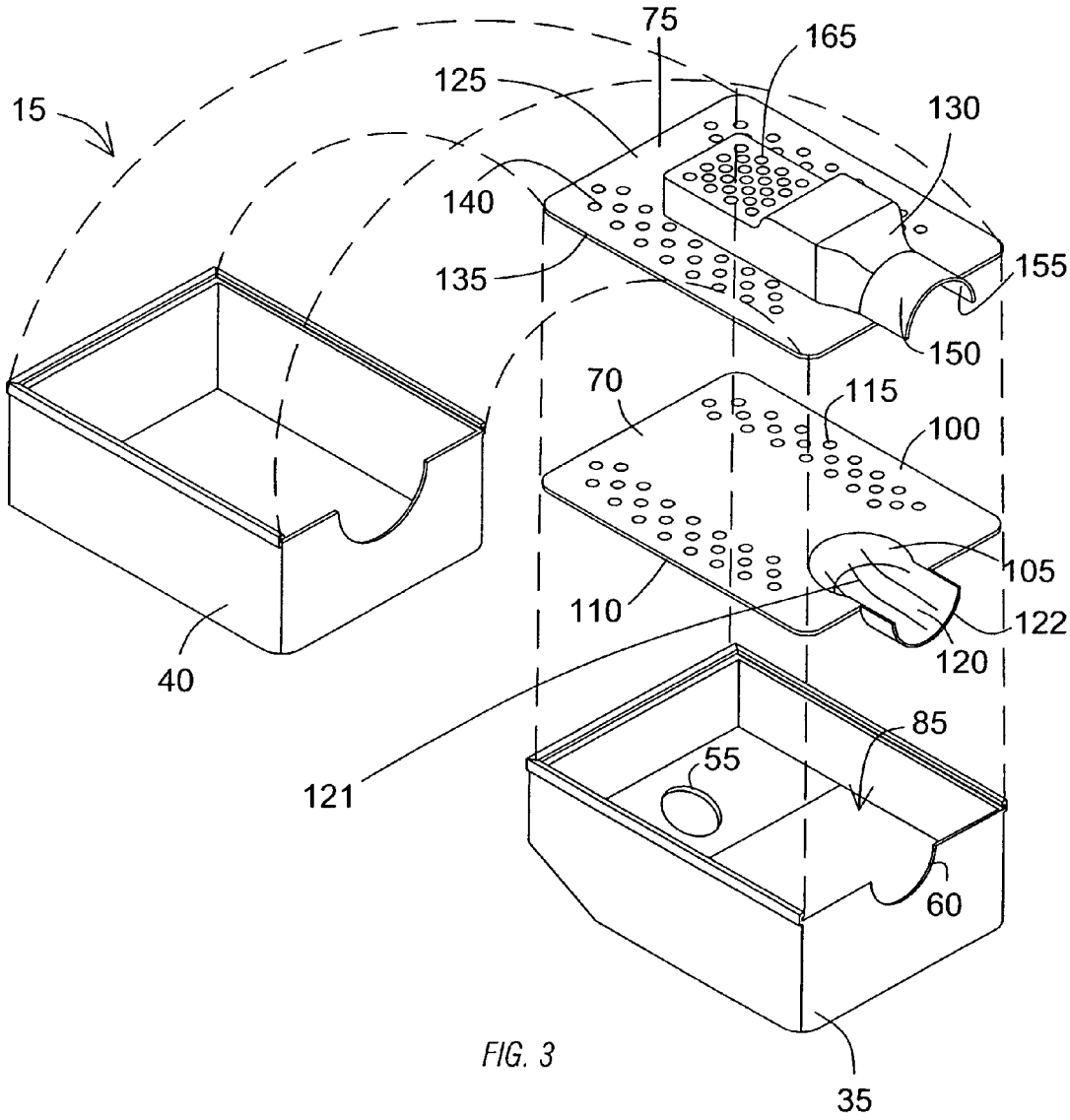
FIG. 3 is an exploded perspective view of the muffler of FIG. 2.

With reference to FIG. 3, the internal features of the muffler 15 are better illustrated. The muffler 15 includes a first baffle plate 70 and a second baffle plate 75 that contact one another to define a muffler baffle 80. The baffle plates 70, 65 are generally formed as stamped metal plates with other construction methods and materials also being suited for use within the muffler 15. The baffle plates 70, 75 each connect to, and are supported by, the muffler housing 30 to divide the muffler interior 50 into an inlet space 85, an intermediate space 90, and a baffle or outlet space 95. Although the muffler baffle 80 is described as being formed from two components, other constructions may employ a single component that functions as the muffler baffle 80. For example, the muffler baffle 80 could be fabricated or welded to form a single component. Alternatively, the muffler baffle 80 could be cast or otherwise formed as a single component. Thus, the invention should not be limited to two-piece or multi-piece muffler baffles 80.

The first baffle plate 70 includes a first divider portion 100 that may be planar, and a first flow guide portion 105. The divider portion 100 includes a perimeter edge 110 that engages the perimeter joint 45 of the housing 30 to provide for a substantially air tight seal. The first divider portion 100 also includes a plurality of apertures 115 that pass through the first baffle plate 70. In another construction, a single large aperture may be used. As one of ordinary skill will realize, the size, shape, and location of the apertures 115 can vary greatly without significantly affecting the operation of the muffler 15. As such, the invention should not be limited to the size, shape, or quantity of apertures 115 illustrated herein.

The first flow guide portion 105 is formed from a non-planar portion 120 of the first baffle plate 70 having a dip 121. As will be described with regard to the function of the muffler, the dip 121 serves to redirect the exhaust flow in a downward direction and inhibits the entry of moisture into the muffler. The non-planar portion 120 terminates at one end to define a portion of a curve 122 along the perimeter edge 110. The remainder of the non-planar portion 120 is contoured to smoothly transition into the first planar portion 100 of the first baffle plate 70.

The second baffle plate 75 includes a second divider portion 125 that may be planar, and a second flow guide portion 130. The second divider portion 125 defines a perimeter edge 135 that engages the perimeter joint 45 to connect the second baffle plate 75 to the muffler housing 30 and provide for a substantially air tight seal. The second divider portion 125 includes a plurality of apertures 140 that pass through the second baffle plate 75. The apertures 140 substantially align with the apertures 115 in the first baffle plate 70 to provide fluid communication between the inlet space 85 and the intermediate space 90. As such, the aligned apertures 115, 140 define a first baffle aperture 145 (shown in FIG. 5). As with the apertures 115 of the first baffle plate 70, the apertures 140 of the second baffle plate 75 can vary greatly in quantity, size, shape, and location beyond that illustrated in FIG. 3. In addition, the apertures 115 of the first baffle plate 70 may differ from the apertures 140 of the second baffle plate 75 so long as at least a portion of some of the apertures 115, 140 align with one another to establish a flow area that is large enough to pass the flow of exhaust gas from the inlet space 85 to the intermediate space 90.

The second flow guide portion 130 is formed from a non-planar portion 150 of the second baffle plate 75. The non-planar portion 150 terminates at one end in a curve 155 that forms a portion of the perimeter 135 of the second baffle plate 75. The curve 155 cooperates with the curve 122 to define a circular outlet 160. The circular outlet 160 intersects with, passes through, and/or cooperates with the housing outlet 60 to complete the muffler outlet. In other constructions, non-circular shapes are formed by the curves 122, 155, as there is no requirement that the outlet 160 be circular.

With the planar divider portion 100 of the first baffle plate 70 and the planar divider portion 125 of the second baffle plate 75 engaged with the perimeter joint 45, the first flow guide portion 105 and the second flow guide portion 130 are spaced apart from one another. The space between the flow guides 105, 130 is the outlet space 95. Thus, the first flow guide portion 105 and the second flow guide portion 130 cooperate to define the baffle or outlet space 95. A plurality of apertures 165 extend through the non-planar portion 150 of the second baffle plate 75 to provide fluid communication between the intermediate space 90 and the outlet space 95. Thus, the plurality of apertures 165 define a second baffle aperture 170 (shown in FIG. 5). Although a plurality of circular apertures 165 is illustrated, it should be understood that other constructions may use a single aperture of any suitable size and shape, or multiple apertures with each aperture having a particular size and shape. Any aperture or combination of apertures can be used so long as the aperture or apertures provide sufficient flow area to pass the flow of exhaust gas from the intermediate space 90 to the outlet space 95.

Figure 4:
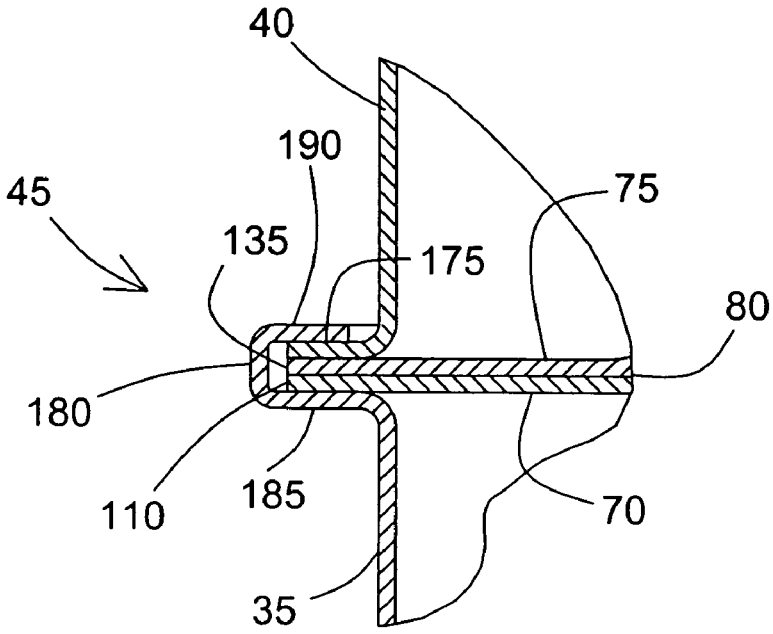
FIG. 4 is an enlarged view of a joint.

Turning to FIG. 4, an enlarged section view better illustrates the perimeter joint 45. The first divider portion 100 of the first baffle plate 70 contacts the second divider portion 125 of the second baffle plate 75. The second half 40 of the housing 30 includes a lip 175 that sits on the second divider portion 125 along the perimeter edge 135. Thus, the perimeter edge 135 of the second baffle plate 75 is sandwiched between the lip 175 and the perimeter edge 110 of the first baffle plate 70. The first half 35 of the housing 30 includes an edge 180 that defines a ledge portion 185 and a hook portion 190. The ledge portion 185 supports the perimeter edge 135 of the second baffle plate 75, the perimeter edge 110 of the first baffle plate 70, and the lip 175. The hook portion 190 engages the lip 175 to sandwich the lip 175, the perimeter edge 110 of the first baffle plate 70, and the perimeter edge 135 of the second baffle plate 75 between the ledge 185 and the hook 190. The ledge 185 and the hook 190 are then squeezed together to provide a substantially air tight seal. It should be understood that the substantially airtight seal may allow some leakage of exhaust gas. However, this leakage is minimal when compared to the total flow of exhaust gas. As such, the seal is considered substantially airtight.

Figure 5:
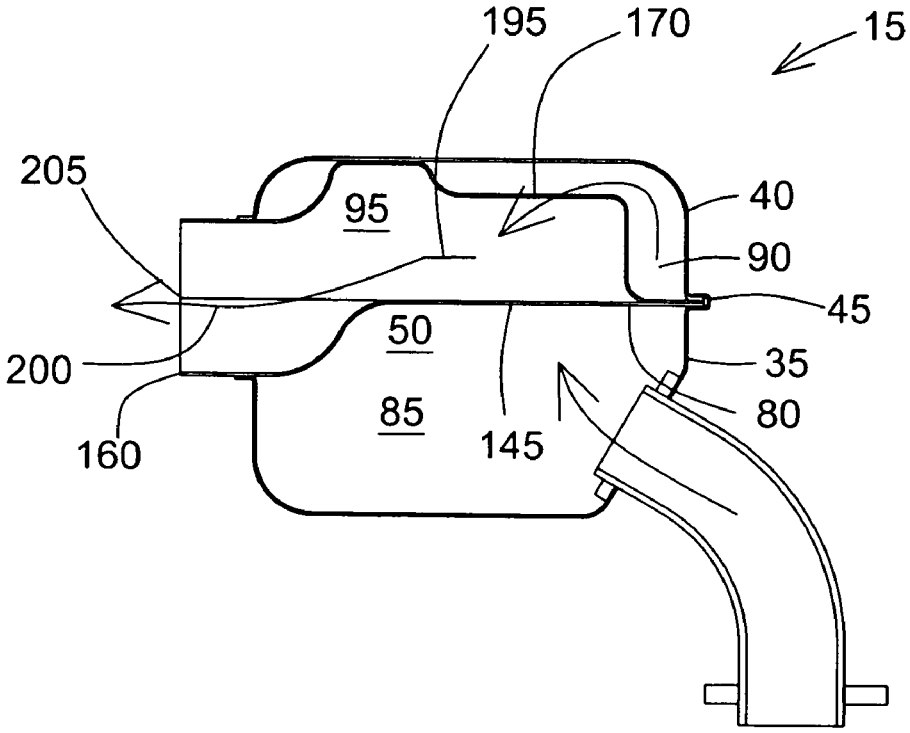
FIG. 5 is a section view of the muffler taken along line 4-4 of FIG. 2.

With reference to FIG. 5, the function of the muffler 15 will be described. Exhaust gas exiting the cylinder, enters the muffler 15 through the inlet 55. Once through the inlet 55, the exhaust gas fills the inlet space 85. The exhaust gas then passes through the first baffle aperture 145 (made up of the apertures 115 in the divider portion 100 of the first baffle plate 70 and the apertures 140 in the divider portion 125 of the second baffle plate 75) to enter and fill the intermediate space 90. From the intermediate space 90, the flow passes through the second baffle aperture 170 (made up of the plurality of apertures 165 in the non-planar portion 150 of the second baffle plate 75) and enters the outlet space 95: The outlet space 95 is formed from the cooperation of the first flow guide portion 105 and the second flow guide portion 130. The flow guide portions 105, 130 are formed to provide a desired flow path out of the muffler 15. With continued reference to FIG. 5, the flow path begins with a leg 195 that is substantially parallel to the divider portions 100, 125 of the baffle plates 70, 75 and is positioned above the plane A-A defined by the planar divider portions 100, 125 of the baffle plates 70, 75. The flow then dips in a downward direction while still proceeding somewhat to the left in FIG. 5. Following the dip 121, the flow travels along a second leg 200 that is substantially parallel to plane A-A. However, this parallel leg 200 is somewhat lower than the first leg 195. The second flow leg 200 passes through the outlet 160 and exits the muffler 15. The outlet 160 is positioned such that its center 205 is located approximately on plane A-A. Other constructions may move this center point 205 above or below the plane A-A depending on the particular application.

Although not exactly S-shaped, the flow path just described will be considered S-shaped for purposes of description. It should be noted that the foregoing discussion describes the muffler 15 as it is oriented in FIG. 5. However, other orientations of the muffler 15 are possible and contemplated by the present invention.

The S-shaped flow path provides an impediment to foreign materials (e.g., dirt, snow, rain, etc.) entering the muffler 15 through the outlet 160. Any substance entering the muffler 15 must make an abrupt direction change to reach the non-planar portion 150 of the second baffle plate 75 and the plurality of apertures 165 that connect the outlet space 95 to the intermediate space 90. Thus, foreign substances, and moisture in particular, have limited access to the components that make up the muffler 15.

A muffler as illustrated herein can be manufactured quickly and inexpensively. Little or no welding is required and most or all of the parts can be formed using stamping or drawing processes. Furthermore, the muffler requires fewer parts than similar functioning mufflers. In addition, the muffler functions to inhibit moisture entry into the interior of the muffler.

Although the invention has been described in detail with reference to certain preferred embodiments, variations and modifications exist within the scope and spirit of the invention as described and defined in the following claims.

What is claimed is:

1. A muffler suited for use in discharging exhaust gas from an engine, the muffler comprising:

a housing defining a muffler interior, an inlet aperture, and an outlet aperture;

a baffle positioned to divide the muffler interior into an inlet space that receives the exhaust gas from the engine and an intermediate space, the inlet space defined by the cooperation of the housing and the baffle, a first aperture defined within the baffle to provide fluid communication between the inlet space and the intermediate space, and a second aperture formed within the baffle to provide for fluid communication between the intermediate space and the outlet aperture; and a flow guide formed as one-piece with the baffle, configured and positioned to be in contact with the exhaust gas and to direct exhaust gas through the outlet aperture such that the flow guide is the last muffler component to contact the exhaust gas.

2. The muffler of claim 1, wherein the housing includes a first half, and includes a second half connected to the first half to define a joint.

3. The muffler of claim 2, wherein the baffle is at least partially supported by the joint.

4. The muffler of claim 2, wherein the first half completely defines the inlet aperture.

5. A muffler suited for use in discharging exhaust gas from an engine, the muffler comprising:

a housing defining a muffler interior, an inlet aperture, and an outlet aperture;

a baffle positioned to divide the muffler interior into an inlet space and an intermediate space, a first aperture defined within the baffle to provide fluid communication between the inlet space and the intermediate space, and a second aperture formed within the baffle to provide for fluid communication between the intermediate space and the outlet aperture; and a flow guide integrally formed as one-piece with the baffle, configured and positioned to be in contact with the exhaust gas and to direct exhaust gas through the outlet aperture, wherein the housing includes a first half, and includes a second half connected to the first half to define a joint, and wherein the first half completely defines the inlet aperture, and wherein the baffle includes a planar portion that defines a baffle plane, wherein the outlet aperture has a center and wherein the center of the outlet aperture is disposed substantially on the baffle plane.

6. The muffler of claim 1, wherein the first aperture includes a first plurality of apertures and the second aperture includes a second plurality of apertures.

7. The muffler of claim 1, wherein the baffle includes a first baffle plate having a first divider portion and a first flow guide portion and a second baffle plate including a second divider portion and a second flow guide portion.

8. The muffler of claim 7, wherein the first baffle plate and the second baffle plate are formed using a process that includes stamping.

9. The muffler of claim 7, wherein the first flow guide portion and the second flow guide portion cooperate to define a baffle interior.

10. The muffler of claim 9, wherein the first aperture provides for substantially all of the fluid communication between the inlet space and the intermediate space and the second aperture provides for substantially all of the fluid communication between the intermediate space and the baffle interior.

11. The muffler of claim 1, wherein the flow guide defines a flow path, the flow path being substantially S-shaped.

12. A muffler suited for use in discharging a flow of exhaust gas from an engine, the muffler comprising:

a housing having a first half, and having a second half connected to the first half to define a perimeter joint and a muffler interior;

a first baffle having a first flow guide portion configured to be exposed to the exhaust gas, and having a first divider portion engaged with the perimeter joint to divide the muffler interior into an inlet space that receives the exhaust gas from the engine and an intermediate space; and a second baffle having a second flow guide portion configured to be exposed to the exhaust gas, and having a second divider portion engaged with the perimeter joint, the first flow guide portion and the second flow guide portion cooperating to define an outlet space from which the exhaust gas is discharged from the muffler, the first flow guide portion, the second flow guide portion, and the housing cooperating to define an outlet, the first baffle and the second baffle cooperating to define a first aperture that provides for fluid communication between the inlet space and the intermediate space and the second baffle defining a second aperture that provides for fluid communication between the intermediate space and the outlet space.

13. The muffler of claim 12, wherein the first half of the housing completely defines an inlet aperture.

14. The muffler of claim 12, wherein the first flow guide portion and the second flow guide portion cooperate to define the baffle interior.

15. The muffler of claim 12, wherein the first aperture includes a first plurality of apertures and the second aperture includes a second plurality of apertures.

16. The muffler of claim 12, wherein the first aperture provides for substantially all of the fluid communication between the inlet space and the intermediate space and the second aperture provides for substantially all of the fluid communication between the intermediate space and the outlet space.

17. The muffler of claim 12, wherein the first flow guide portion and the second flow guide portion cooperate to define a flow path, the flow path being substantially S-shaped.

18. The muffler of claim 12, wherein the first baffle and the second baffle are formed using a process that includes stamping.

19. An engine comprising:

a cylinder including an exhaust port for the discharge of exhaust gas;

a piston arranged for reciprocal movement within the cylinder;

an air/fuel mixing device operable to mix a flow of air and a flow of fuel;

a muffler having a housing defining a muffler interior, an inlet aperture for receiving the exhaust gas, and an outlet aperture for discharging the exhaust gas;

a baffle disposed within the housing to define an inlet space, an intermediate space, and an outlet space, the inlet space defined by the cooperation of the housing and the baffle to receive the exhaust gas from the cylinder, and the outlet space fully defined by the baffle to discharge the exhaust gas from the muffler, the baffle including a first aperture that provides fluid communication between the inlet space and the intermediate space and a second aperture that provides fluid communication between the intermediate space and the outlet space; and a flow guide formed as one piece with the baffle, configured and positioned to be in contact with the exhaust gas and to guide exhaust gas from the outlet space out of the muffler.

20. The engine of claim 19, wherein the housing includes a first half, and includes a second half connected to the first half to define a joint.

21. The engine of claim 20, wherein the baffle is at least partially supported by the joint.

22. The engine of claim 20, wherein the first half completely defines the inlet aperture.

23. An engine comprising:

a cylinder including an exhaust port for the discharge of exhaust gas;

a piston arranged for reciprocal movement within the cylinder;

an air/fuel mixing device operable to mix a flow of air and a flow of fuel;

a muffler having a housing defining a muffler interior, an inlet aperture for receiving the exhaust gas, and an outlet aperture for discharging the exhaust gas;

a baffle disposed within the housing to define an inlet space, an intermediate space, and an outlet space, the baffle including a first aperture that provides fluid communication between the inlet space and the intermediate space and a second aperture that provides fluid communication between the intermediate space and the outlet space; and a flow guide integrally formed as one piece with the baffle, configured and positioned to be in contact with the exhaust gas and to guide exhaust gas from the outlet space out of the muffler, wherein the baffle includes a planar portion that defines a baffle plane, wherein the outlet aperture has a center and wherein the center of the outlet aperture is disposed substantially on the baffle plane.

24. The engine of claim 19, wherein the first aperture includes a first plurality of apertures and the second aperture includes a second plurality of apertures.

25. The engine of claim 19, wherein the baffle includes a first baffle plate having a first divider portion and a first flow guide portion and a second baffle plate including a second divider portion and a second flow guide portion.

26. The engine of claim 25, wherein the first flow guide portion and the second flow guide portion cooperate to define the outlet space.

27. The engine of claim 25, wherein the first baffle plate and the second baffle plate are formed using a process that includes stamping.

28. The engine of claim 19, wherein the first aperture provides for substantially all of the fluid communication between the inlet space and the intermediate space and the second aperture provides for substantially all of the fluid communication between the intermediate space and the outlet space.

29. The engine of claim 19, wherein the flow guide defines a flow path, the flow path being substantially S-shaped.

30. A muffler suited for use in discharging exhaust gas from an engine, the muffler comprising:

a housing defining a muffler interior, an inlet aperture, and an outlet aperture;

a baffle positioned to divide the muffler interior into an inlet space that receives the exhaust gas from the engine and an intermediate space, the inlet space defined by the cooperation of the housing and the baffle, a first aperture defined within the baffle to provide fluid communication between the inlet space and the intermediate space, and a second aperture formed within the baffle to provide for fluid communication between the intermediate space and the outlet aperture; and a flow guide formed as one-piece with the baffle, configured and positioned to be in contact with the exhaust gas and to direct exhaust gas through the outlet aperture, wherein the baffle completely defines an outlet space that receives exhaust gas from the intermediate space and directs the exhaust gas out through the outlet aperture.

* * * * *